United States Patent [19]

Plough

[11] Patent Number: 4,708,181

[45] Date of Patent: Nov. 24, 1987

[54] FEED WORKS FOR VENEER CHIPPERS

[75] Inventor: Irving L. Plough, Snohomish, Wash.

[73] Assignee: Acrowood Corporation, Everett, Wash.

[21] Appl. No.: 866,624

[22] Filed: May 23, 1986

[51] Int. Cl.[4] ..... B27B 31/00; B27L 11/00

[52] U.S. Cl. ..... 144/249 R; 144/176; 144/242 R

[58] Field of Search ..... 241/92, 245, 255, 278; 144/162 R, 172, 242 R, 176, 243, 244, 249 R, 250 R, 250 A

[56] References Cited

U.S. PATENT DOCUMENTS

| | | | |
|---|---|---|---|
| 749,072 | 1/1904 | Marsh . | |
| 2,570,926 | 10/1951 | Elmendorf . | |
| 2,756,788 | 7/1956 | Fish et al. . | |
| 2,811,183 | 10/1957 | Mottef | 144/172 |
| 2,969,095 | 1/1961 | Brookhyser et al. | 144/172 |
| 3,335,771 | 8/1967 | Ledergerber . | |
| 3,718,169 | 2/1973 | Plough . | |
| 3,810,501 | 5/1974 | Horel . | |

*Primary Examiner*—W. D. Bray

*Attorney, Agent, or Firm*—Seed and Berry

[57] ABSTRACT

An improved apparatus is described for chipping a resilient material such as layers of scrap wood veneer of the type that includes feeding the resilient material across an anvil into contact with a rapidly moving chipping blade. The apparatus includes a crush roll for holding the material down as it approaches the anvil surface. The crush roll is journal-mounted on a pair of support arms swing-mounted on a framework to respond to variations in level of material received by the apparatus. Hold-down fingers are pivotably supported upon a finger shaft and their fingertips hold the veneer onto the anvil as close as practicable to the knife blade. A compensating linkage carries the finger shaft and is pivotally connected to the support arms and to the frame to which the support arms are pivotally connected. The compensating linkage compensates for the horizontal amount that the fingertips would otherwise travel as a horizontal component of the swing arc of the crush roll as it responds to varying material levels. As a result, the fingertips travel a substantially vertical path responsive to movement of the crush roll.

9 Claims, 3 Drawing Figures

FEED WORKS FOR VENEER CHIPPERS

TECHNICAL FIELD

The invention is principally concerned with apparatus for producing wood chips from veneer clipping wastes or the like, typically generated in the process of making wood products such as plywood, for example. More particularly, the apparatus of the invention is directed toward improving the quality of products, such as wood chips, produced from such wastes.

BACKGROUND OF THE INVENTION

A conventional chipper for converting veneer wastes into useful chips is described by Elmendorf in U.S. Pat. No. 2,570,926. In Elmendorf, multiple layers of scrap wood veneer are transported on a conveyor and discharged onto and across a stationary anvil surface. At the discharge edge of the anvil, the veneer is contacted with a chipping blade that rotates transverse to the conveyor and strikes the veneer adjacent the anvil surface. A problem well recognized in the art in such apparatus when used to cut resilient or springy type materials is that the materials tend to rebound from impact with the blade. The rebound action adversely affects chip quality. Elmendorf thus provides a hold-down mechanism employing a plurality of shoes extending across the width of the conveyor to rest on the veneer mat and hold it onto the anvil surface during cutting.

Hold-down mechanisms such as proposed by Elemdorf generate a number of difficulties. One difficulty relates to the framework necessary to support the hold-down apparatus. This supporting framework typically overlies the conveyor and limits how much veneer may pass under it. Such flow restriction limits the ability of the chipping apparatus to handle the substantial surges in the level of veneer material on the conveyor that often occur. Such flow limitations result in spillage and loss of veneer as well as jamming of the machinery.

Another difficulty with conventional hold-down apparatus is that the closeness that the hold-down shoes can approach the cutting blade is limited because normally the hold-down apparatus is pivoted from a relatively long supporting arm, thereby causing the tip of the hold-down mechanism to trace an arcuate path in response to flow variation of material across the anvil surface. The tip of the hold-down mechanism closest to the blade must be fixed a sufficient distance away from the blade to accommodate the horizontal component of the arc that the hold-down tip will travel under varying flow conditions. With respect to chipping wood veneers, this adjustment away from the chipping blade has a significant negative impact on chip quality. A substantial percentage of pin chips and splinters are produced that are undesirable in many preferred uses for the chips, such as pulping.

Plough, in U.S. Pat. No. 3,718,169 describes an apparatus for chipping scrap wood veneer that includes a deeply slotted hold-down roll supported upon a framework attached to a feed drum, both bearing upon the veneer as it travels along the feed conveyor. Plough includes a plurality of substantially parallel fingers mounted on a cross-shaft supported upon the chipper frame. The fingers extend through the slots on the crush roll to hold veneer onto the anvil surface near the knife blade. The apparatus includes a flexible air bag for exerting a downward force on the fingers and, hence, on the veneer fed to the chipper. Again, a disadvantage of this arrangement is that the physical supporting structure limits the capacity of the apparatus to handle surge flows of veneers. The finger arrangement also is such that the fingertips travel an arcuate path as they pivot to accommodate veneer flow. Thus the hold-down tips must be spaced back from the blade, reducing their effectiveness, since veneer rebound is not completely controlled.

DISCLOSURE OF THE INVENTION

The present invention is useful in apparatus for chipping a resilient material and provides a means for supporting hold-down fingers in a manner that effectively prevents material rebound in response to a chipper blade striking the material. The feed works of the invention provides means for supporting hold-down fingers such that in response to material flow variation, the fingertips respond substantially vertically. The supporting means or feed works permits the hold-down fingertips to more closely approach the knife blade than conventional pivoting suspensions, effectively preventing rebound at any flow conditions.

The fingertip control substantially reduces the production of undesired pin chips. The present invention also provides a feed works that increases the ability of the chipping apparatus to tolerate surges or variations of the level of material flow to the apparatus.

In a preferred embodiment of the feed works apparatus, scrap veneer or other resilient type material is layered on a transporting conveyor and is conveyed across an anvil into contact with an adjacent chipping knife. A rotating crush roll holds the material against the conveyor as the material approaches the anvil. The crush roll is supported by a pair of support arms pivoted from a framework on each side of the conveyor so that the roll adjusts to surging levels of material flow on the conveyor. A plurality of circumferential slots in the crush roll are provided to accommodate a plurality of pressure fingers for holding the material onto the anvil adjacent the knife.

The fingers are in parallel alignment across the width of the conveyor and pivotally mounted on a shaft which is linked to the crush roll support arms. The fingers extend downwardly and horizontally toward the knife blade, pass under the crush roll through its circumferential slots, and extend until the tips of the fingers are sufficiently close to the knife blade to hold the veneer on the anvil to prevent veneer rebound during cutting, independently of the level of veneer flowing across the anvil surface.

A compensating linkage is provided between the crush roll support arms which pivotally carries the fingers and the framework. The linkage causes the fingertips to move substantially vertically in response to varying levels of material flow across the anvil surface. The linkage is pivoted upon the crush roll supporting arms and compensates, with respect to the fingers, for the horizontal component of the arc traced by the crush roll in a response to material surges. The compensating linkage insures that the movement of the fingertips is substantially vertical at all flow conditions such that rebound action is reduced, substantially reducing the level of inferior product, such as pin chips.

The compensating linkage mechanism includes a pair of vertically oriented compensating links joined at their lower ends by a substantially horizontal sleeve therebetween. The sleeve receives a shaft that pivotably secures the linking mechanism to the crush roll support arms. The upper ends of the vertical links have a sleeve fixed thereto extending outwardly with respect to the conveyor. The sleeve pair receives and supports a finger shaft for centrally pivotably supporting all of the fingers across the width of the conveyor. At its outer end at least one of the sleeve pair has a lever arm fixed thereto which extends at an angle that is rearward and downward with respect to conveyor flow. A linking rod is pivotably connected to the lever arm and the framework whereby the vertical compensating links supporting the finger shaft are moved forward or rearward as the crush roll responds to flow variations, said forward/backward movement being equal to the horizontal component of the arcuate movement of the finger-supporting system. As the crush roll responds to flow variations, the response of the hold-down fingertips is a vertical movement such that the distance between the tip of the fingers and the knife blade remains substantially the same independent of flow variations.

The framework for supporting the crush roll supporting arms may be a pair of substantially vertical members on each side of the conveyor, extending upwardly sufficiently to support the roll and its attendant mechanisms such that it does not obstruct ordinary surge flows of veneer on the conveyor.

The individual response of each fingertip to local variation in material flow on the conveyor is limited by including a pair of stop rods, one mounted on the supporting framework and the other mounted on the crush roll support arms, so that the stop rods are in a parallel spaced relationship transverse to said conveyor. The stop rods are located at opposite sides of the finger shaft and above the fingers so as to limit both up and down pivotal movement of the fingers, relative to the conveyor within a desired range of local response to the fingertips.

BEST MODE TO CARRY OUT THE INVENTION

Figure 1:
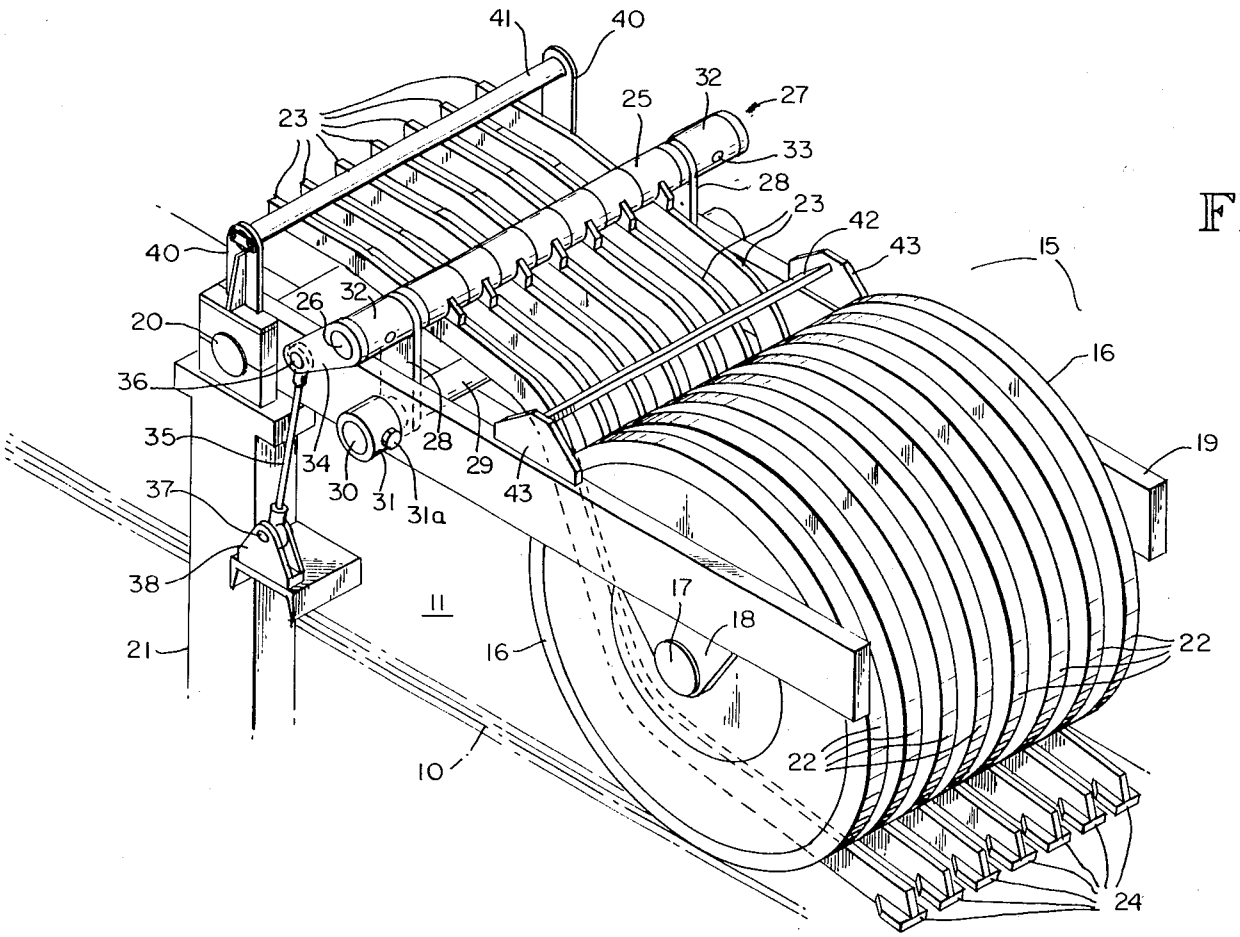
FIG. 1 is an isometric projection of the feed works apparatus of the invention.
Figure 2:
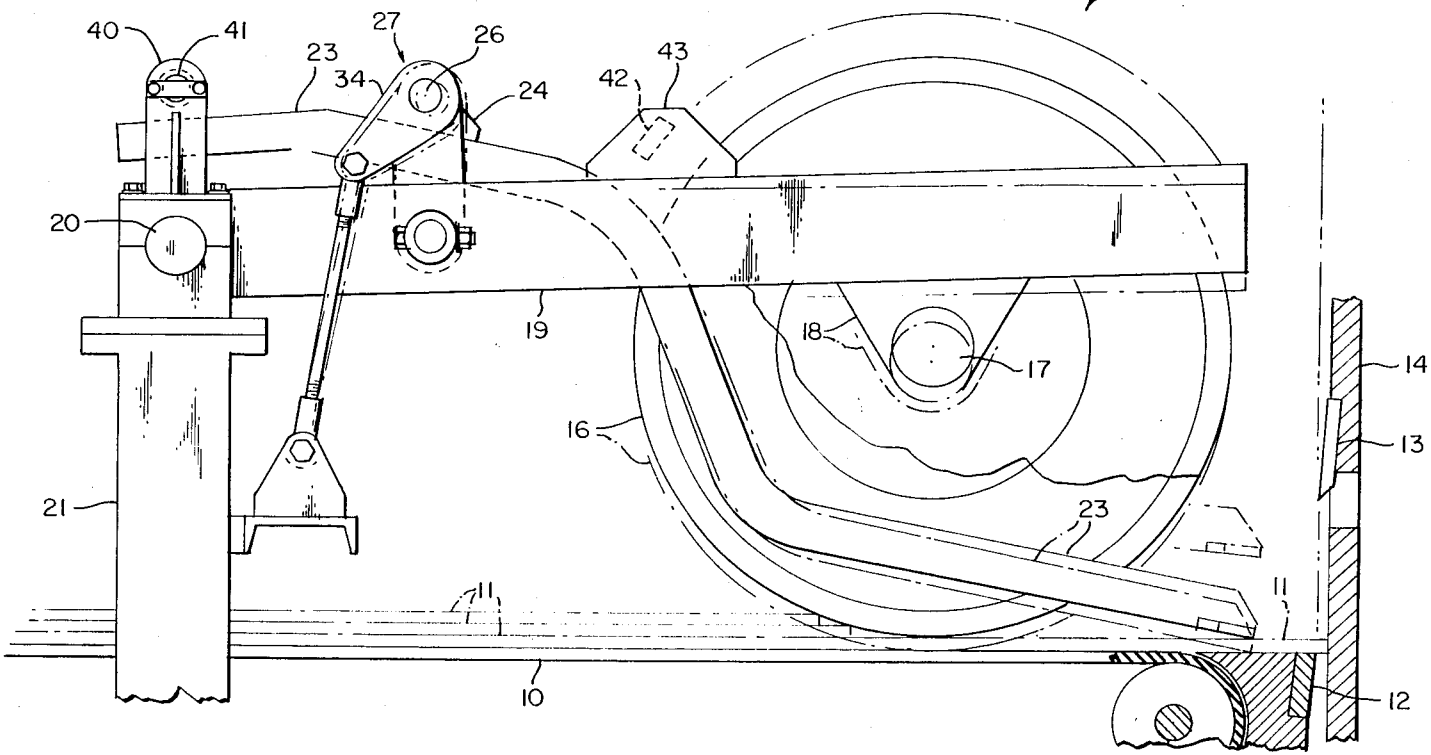
FIG. 2 is an elevational view of the apparatus of FIG. 1.
Figure 3:
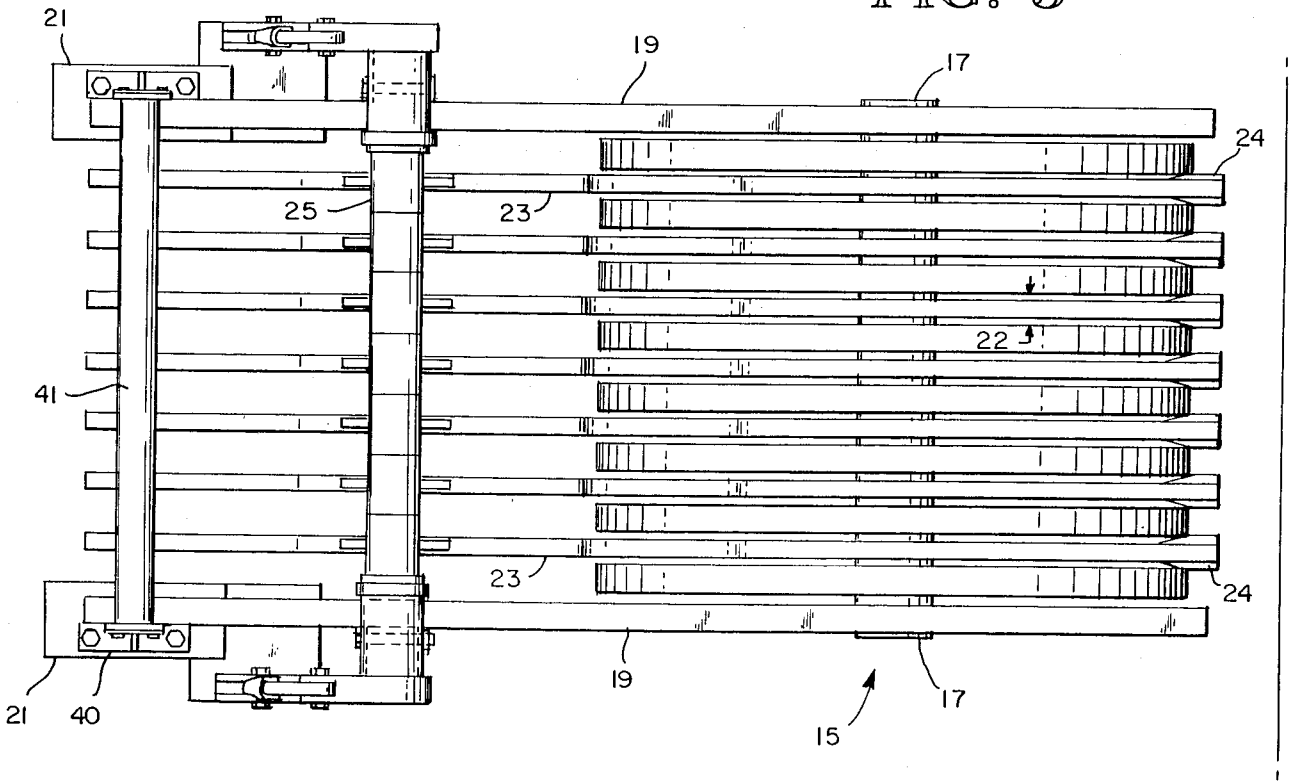
FIG. 3 is a plan view of the apparatus of FIG. 1.

Referring to FIGS. 1–3, a conveyor 10 advances layered scrap veneer 11 across a stationary anvil surface 12 into contact with a knife blade 13 mounted upon a supporting plate 14 that rotates transversely to the conveyor, as described by Ledergerber in U.S. Pat. No. 3,335,771.

A crush roll assembly 15 extends across the width of the conveyor 10, including a heavy roll 16 rotating about its longitudinal axial shaft 17 journaled in a pair of bearing blocks 18. These bearing blocks are mounted on the underside of a pair of parallel support arms 19 that are spaced sufficiently far apart to be outside the transverse width of the conveyor 10 and thus not interfere with veneer flow. Support arms 19 are pivotably attached by stub shafts 20, including appropriate bearings, to a pair of vertical frame members 21, mounted on each side of the conveyor 10 and supported by the machine framework (not shown). The crush roll 16, swingably mounted by its supporting arms 19 pivoting at the stub shafts 20, accommodates veneer flow variations. The supporting structure is designed to avoid limiting the depth of veneer on the conveyor, in contrast to the prior art. Thus vertical framework supporting members 21 are of such height that a depth of veneer up to about 20 inches high is accommodated, in contrast to the 7-inch surge capacity of the unit described by Plough in U.S. Pat. No. 3,718,169. As in U.S. Pat. No. 3,728,169, the roll 16 is preferably driven by a motor (not shown) which engages the axial shaft 17 of the roll.

The roll 16 is segmented or provided with deep circumferential grooves 22 to accommodate a plurality of pressure or hold-down fingers 23 which extend side-by-side adjacent to one another transversely across the conveyor 10. The fingers 23 are cut in a somewhat sinusoidal shape having an upper horizontal component for supporting attachment by individual pivots 25 above the crush roll arms 19. The fingers then curve downwardly between the supporting arms to adjacent the conveyor 10 where they pass through the grooves 22 in the crush roll 16. The fingers then extend substantially horizontally along the conveyor and end substantially parallel to the anvil surface, as close as practicable to the knife blade 13. Each finger is provided with a widened tip 24 to insure continuous hold-down across the width of the conveyor and has a sleeve element 25 fixed to the top thereof that rocks on a supporting finger shaft 26 extending across the width of the conveyor. The sleeve elements 25 are of sufficient length to properly space the fingers transversely to the conveyor.

The finger shaft 26 is supported above the crush roll supporting arms 19 by means of a compensating linkage mechanism 27. If the finger shaft 26 were pivotably supported directly on the crush roll arms 19, the fingertips would ordinarily trace an arc, as does the crush roll 16 bearing on the frequently changing level of veneer flowing thereunder on the conveyor at the end of the supporting arms 19 pivoting about the stub shafts 20. The compensating linkage 27, by moving the finger shaft 26 relative to the arms 19 and the supporting framework 21, offsets the horizontal component of the arc that the fingertips 24 would ordinarily travel. The fingertips 24 therefore move substantially vertically only, in response to flow changes. As a result, the fingertips 24 may be advanced closer to the knife blade than conventionally pivoted hold-down devices.

The compensating linkage 27 includes a pair of vertical link members 28 spaced apart and connected together by a sleeve 29 that receives a cross shaft 30 for attaching the system 27 to the crush roll support arms 19. The shaft 30 passes through bearing supports in the arms 19 and is axially held in position by end collars fitted with set screws 31a. The upper portion of each vertical linking member 28 is fixed to a sleeve 32 extending outwardly with respect to the conveyor. The sleeve pair 32 receives the finger shaft 26, thereby pivotally supporting the fingers 23. The shaft 26 is secured as by pins 33 to the sleeves 32.

As part of the compensating linkage 27, a lever arm 34 is fixed to the outer end of each upper sleeve 32 and is angled downwardly and rearwardly with respect to conveyor flow to make pivotal connection by a pin 36 to a compensating rod 35. At its opposite end, the rod 35 is pivotably attached by pin 37 to the forked forward end of a bracket 38 that is fixed to the feed works supporting framework for the conveyor (not shown).

The configuration of the lever 34, the length of the compensating rod 35 and the bracket means 38 by which the compensating linkage system 27 is secured to the frame, are selected to achieve the horizontal component compensation function of the system 27.

The lower end of the compensating rod 35 may be attached to the main frame supporting the conveyor or some other bracket means 38 so long as it accomplishes its function. Typically, the compensating rod 35 is provided with a clevis arrangement for length adjustment that allows adjustment of the distance between the fingertips 24 and the chipper knives 13.

Adjustment of the fingertips 24, with respect to local variations in veneer flow, is controlled by extending the fingers rearward from their pivot 24 substantially horizontally, adjacent the cross shaft 20 for the crush roll support arms. A pair of auxiliary support members 40 surmounting frame members 21 provide support for a rear stop rod 41 that extends across the width of the conveyor 10. When the crush roll 16 and the support arms 19 rise, the fingers 23 engage the stop rod 41 causing the tips to rise with the roll 16. A second stop rod or bar 42 is supported by brackets 43 fixed to the support arms 19. The stop rod 42 limits the maximum vertical movement of the fingertips 24 with respect to the crush roll 16.

In operation, the crush roll 16 accommodates varying depths of veneer thicknesses on the conveyor by the vertical swinging movement of the support arms 19 and the compensating linkage carried by the support arms is restrained by the link rod 35. The linkage causes the finger shaft 26, and hence the hold-down fingers, to move horizontally to compensate for the horizontal component of the arcuate movement of the pivoting crush roll. The overall effect is that the tips of the fingers move substantially vertically in response to flow variations on the conveyor. Thus, the fingertips remain as close as practicable to the knife blades, independent of the variation of flow of veneer on the conveyor.

In setting up the compensating link system, the compensating link member 35 is positioned substantially vertically at some average veneer flow. As the flow decreases, the crush roll supporting arms lower as the crush roll follows the declining veneer flow and the compensating linkage is rotated about the cross shaft 30 on the supporting arms toward the knife line in response to the fixed length of the link rod 35 attached to the frame. Rotating the compensating linkage toward the knife line moves the finger shaft 26 in the direction of conveyor flow, and hence causes the fingertips to move toward the knife line. The length of the rod 35 is adjusted to assure that the fingertip is sufficiently close to the knife line at this low-flow condition to hold the veneer onto the anvil to prevent rebound and achieve quality chips.

As veneer flow depth increases, the crush roll 16 and its supporting arms 19 swing upwardly, supported by the thicker layer of veneer. As the arms swing upwardly, the compensating unit 28, 32, 34 swings counter clockwise (as viewed in FIG. 1) on shaft 20 away from the knife line, restrained by the link rod 35. The fingers pivot in response about the finger shaft 26 at the top of the compensating linkage and move rearward with the finger shaft as the crush roll moves upward to thereby compensate for the forward movement of the fingertips due to upward swinging thereof to accommodate the thicker layer of material on the conveyor.

From the foregoing, it will be appreciated that, although embodiments of the invention have been described herein for purposes of illustration, various modifications may be made without deviating from the spirit and scope of the invention. Accordingly, the invention is not limited except as by the appended claims.

I claim:

1. An apparatus for feeding resilient material being transported on a conveyor means across an anvil into contact with a knife, comprising:

a frame supporting said conveyor and apparatus;

a rotating crush roll for holding said material onto said conveyor as said material approaches said anvil, said roll being formed with a plurality of circumferential slots;

support arms swing-mounted on the frame and rotatably supporting said crush roll such that said roll adjusts to variations of the levels of material on said conveyor;

a finger shaft located higher than said crush roll support arms;

a plurality of pressure fingers for holding said material onto said anvil and having fingertips adjacent said knife, said fingers being generally independently pivotably mounted side-by-side upon said finger shaft at a level above said crush roll support arms, and said fingers passing from said finger shaft under said crush roll through said circumferential slots to their fingertips; and a compensating linkage pivotally connected to said support arms and frame, said compensating linkage supporting said finger shaft and offsetting for said fingertips the horizontal component of the arc traced by the crush roll and fingers as they respond to varying material levels, whereby the fingertips continually apply pressure to hold said material onto said anvil adjacent said knife.

2. The apparatus of claim 1 wherein said resilient material is wood veneer.

3. The apparatus of claim 1 wherein said framework to which the crush roll support arms are connected includes a pair of supports which are exterior to said conveyor and extend above the level of said conveyor, said support arms being pivotably connected to said support sufficiently above said conveyor such that varying levels of material on said conveyor are not obstructed by said framework.

4. The apparatus of claim 1 wherein two stops are provided extending transversely to the conveyor means above the fingers, one stop being mounted on said frame and the second stop being mounted upon said crush roll support arms, and wherein the response of each said fingertip to local variations in material level on the anvil is provided by the pivoting of said fingers on the finger shaft and is limited by said stops.

5. An apparatus for feeding resilient material across a surface of an anvil into a knife blade moving adjacent said anvil, comprising:

a crush roll holding down said material as it moves adjacent said anvil;

a plurality of substantially parallel fingers extending adjacent said crush roll, said fingers arrayed across the width of said anvil, each finger including a fingertip for holding down said material onto said anvil as said material is cut by said blade;

a frame;

support arms swingably mounted on said frame and supporting said crush roll such that said roll, in response to variations in levels of material, traces an arcuate path continuously holding down said material adjacent said anvil;

a finger shaft pivotably supporting said fingers such that the fingers individually pivot about said shaft in response to material variations moving across said anvil at each individual fingertip; and a compensating linkage pivotably fixed to said crush roll support arms and frame, and providing support for said finger shaft, said compensating linkage adjusting the position of said finger shaft such that the horizontal component of the arc traced by said crush roll and fingers due to changes in the depth of said material is substantially eliminated for said fingertips, whereby said fingertips trace a substantially vertical path in response to the crush roll arcuate trace, thereby continually holding down material onto said anvil adjacent said knife during cutting, independently of variations of material levels.

6. The apparatus of claim 5 wherein said compensating linkage comprises:

a pair of upright, transversely spaced compensating links;

a shaft passing through said links and pivotably securing the linkage to said crush roll support arms;

a respective sleeve fixed to the upper portion of each upright compensating link and extending outwardly with respect to the respective of said support arms, the sleeve pair receiving said finger shaft therebetween, each said sleeve having at its outermost end a lever arm fixed thereto at an angle such that the lever arm extends rearwardly and downwardly with respect to said cutting blade; and a linking rod pivotably connecting said lever arm to said frame.

7. The apparatus of claim 6 wherein said resilient material is wood.

8. The apparatus of claim 7 wherein said wood is a multi-layered mat of wood veneers.

9. The apparatus of claim 6 wherein said linking rod is adjustable in length and said adjustment controls the distance that the fingertips are spaced from said cutting knife blade.

* * * * *